US006305483B1

(12) United States Patent
Portwood

(10) Patent No.: US 6,305,483 B1
(45) Date of Patent: Oct. 23, 2001

(54) MULTI-PIECE ROTARY CONE DRILL BIT SEAL

(75) Inventor: Gary R. Portwood, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/283,495

(22) Filed: Apr. 1, 1999

Related U.S. Application Data

(60) Provisional application No. 60/080,435, filed on Apr. 2, 1998.

(51) Int. Cl.[7] ..... E21B 10/22

(52) U.S. Cl. ..... 175/371; 277/323; 277/407; 277/589; 277/944; 175/57

(58) Field of Search ..... 175/327, 331, 175/371, 372; 277/322, 323, 326, 336, 345, 370, 407, 589, 944

(56) References Cited

U.S. PATENT DOCUMENTS

| | | | |
|---|---|---|---|
| 2,360,731 | 10/1944 | Smith | 286/26 |
| 2,360,735 | 10/1944 | Smith | 286/26 |
| 3,199,540 | 8/1965 | Forster | 137/625.69 |
| 3,328,041 | 6/1967 | Bloom et al. | 277/165 |
| 3,351,350 | 11/1967 | Shepler | 277/58 |
| 3,397,928 | 8/1968 | Galle | 308/8.2 |
| 3,467,448 | 9/1969 | Galle | 308/8.2 |
| 3,765,495 | 10/1973 | Murdoch et al. | 175/371 |
| 3,788,654 | 1/1974 | Mandley | 277/229 |
| 3,918,726 | 11/1975 | Kramer | 277/227 |
| 4,200,343 * | 4/1980 | Highsmith . | |
| 4,223,896 | 9/1980 | Ström | 277/207 |
| 4,262,914 | 4/1981 | Roley | 277/84 |
| 4,304,415 | 12/1981 | Wolf et al. | 277/205 |

(List continued on next page.)

FOREIGN PATENT DOCUMENTS

| | | |
|---|---|---|
| 274 262 A1 | 12/1989 | (DE) . |
| 681312 | 10/1952 | (GB) . |
| 1074756 | 7/1967 | (GB) . |
| 2 012 375 | 7/1979 | (GB) . |
| 2 318 137 A | 4/1998 | (GB) . |
| 2 318 138 A | 4/1998 | (GB) . |
| 6174105 | 6/1994 | (JP) . |
| WO81/03044 | 10/1981 | (WO) . |

* cited by examiner

*Primary Examiner*—Roger Schoeppel
(74) *Attorney, Agent, or Firm*—Christie, Parker & Hale, LLP

(57) ABSTRACT

Multi-piece seals of this invention include an annular seal body that is formed from an elastomeric energizing material, and that has a static seal surface along one surface and a contacting surface along another surface. A remaining seal portion in the form of a seal jacket or seal cap is connected to the seal body along the contacting surface to provide a dynamic sealing surface thereto. The seal jacket or cap is formed from a material that is different from the seal body and, more Specifically, from a material that displays improved wear resistance when compared to the seal body. A preferred seal jacket or cap material is a composite construction including a nonelastomeric polymer fabric that is impregnated with an elastomeric material. The seal jacket or cap is configured to connect with the seal body by mechanical attachment means independent of chemical cross-linked bonding. Multi-piece seals of this invention can be formed from two components, e.g., the seal body and the seal jacket or seal cap, or can be formed from three or more components, e.g, the seal body, seal jacket or cap, and one or more stiffening supporting members interposed therebetween.

49 Claims, 7 Drawing Sheets

U.S. PATENT DOCUMENTS 4,305,595 12/1981 Miyagishima et al. ..... 277/152
4,466,621 8/1984 Garner et al. ..... 277/84
4,516,641 * 5/1985 Burr .
4,776,599 10/1988 Vezirian ..... 277/95
4,796,858 1/1989 Kabel ..... 251/171
5,027,911 * 7/1991 Dysart .
5,195,757 3/1993 Dahll, V ..... 277/134
5,269,539 12/1993 Martin ..... 277/228
5,323,863 6/1994 Denton ..... 175/57
5,362,073 11/1994 Upton et al. ..... 277/92
5,380,016 1/1995 Reinsma et al. ..... 277/152
5,842,701 * 12/1998 Cawthorne et al. .
6,033,117 * 3/2000 Cariveau et al. .

MULTI-PIECE ROTARY CONE DRILL BIT SEAL

This application claims benefit of provisional application Ser. No. 60/080,435 filed Apr. 2, 1998.

FIELD OF THE INVENTION

This invention relates to seals used for retaining the lubricant around a bearing journal in a rotary cone rock or mining drill bit used for drilling oil wells or the like. More particularly, this invention relates to seals having a multi-piece construction that provide an improved degree of temperature and friction resistance, thereby enhancing the service life of both the seal and bit.

BACKGROUND OF THE INVENTION

Rock bits are employed for drilling wells, blast holes, or the like in subterranean formations for oil, gas, geothermal steam, minerals, and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and/or the bit body are rotated in the bore hole, and each cone is caused to rotate on its respective journal as the cone contacts the bottom of the bore hole being drilled. As such a rock bit is used for drilling deep wells, tough formations, high pressures and temperatures are encountered.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One cause of rock bit failure is due to severe wear that occurs on journal bearings on which the cutter cones are mounted. These bearings can be friction or roller type bearings and can be subject to high pressure drilling loads, high hydrostatic pressures in the hole being drilled, and high temperatures due to drilling, as well as elevated temperatures in the formation being drilled. The journal bearings are lubricated with grease adapted to such severe conditions. The grease is retained within the rock bit, to lubricate the journal bearings, by a seal. The seal is typically in the form of a ring and includes a dynamic seal surface, that is placed in rotating contact against a journal surface, and a static seal surface, that is placed in contact against a cone surface. The seal must endure a range of different temperature and pressure conditions at the dynamic and static seal surfaces during the operation of the rock bit to prevent the grease from escaping and/or contaminants from entering and, thereby ensure that the journal bearings remain sufficiently lubricated.

Journal seals known in the art are typically provided in the form of an O-ring type seal made from exclusively rubber or elastomeric materials. While journal seals formed from such rubber or elastomeric materials display excellent sealing properties of elasticity and conformity to mating surfaces, they display poor tribiological properties, low wear resistance, a high coefficient of friction, and a low degree of high-temperature endurance and stability during operating conditions. Accordingly, the service life of rock bits equipped with such seals is defined by the limited ability of the elastomeric seal material to withstand the different temperature and pressure conditions at each dynamic and static seal surface.

Example O-ring seals known in the art that have been constructed in an attempt to improve O-ring seal service life include a multiple hardness O-ring comprising a seal body formed from nitrile rubber, and a hardened exterior skin surrounding the body that is formed by surface curing the exterior surface of the nitrile rubber. Although the patent teaches that the O-ring seal constructed in this manner displays improved hardness and abrasion resistance, the act of hardening the entire outside surface of the seal body causes the seal to loose compressibility and other related properties that are important to the seal's performance at the static seal surface.

Another example O-ring seal is a drill bit seal having a dynamic and static seal surface formed from different materials. The dynamic seal surface is formed from a relatively low friction material comprising a temporary coating of Teflon that is deposited onto a inside diameter surface of the seal. The static seal surface is formed from the same material that is used to form the seal body. The Teflon surface acts to improve the wear resistance of the seal at the dynamic seal surface. However, the use of Teflon on the dynamic seal surface only provides a temporary improvement in the coefficient of friction and easily wears away due to its low wear resistance.

A still other example O-ring seal is one comprising a dynamic seal surface, formed from a single type of elastomeric material, and that has a static seal surface that is formed from an elastomeric material different than that used to form the dynamic seal surface. The elastomeric materials used to form the static seal surface is less wear resistant than the elastomeric material used to form the dynamic seal surface, and the elastomeric materials forming the dynamic and static seal surfaces are bonded together by chemically cross-linking to form the seal body. Although such seal construction provides a improved wear resistance at the dynamic seal surface, when compared to single-elastomer seals, the amount of wear resistance that is provided is still limited to the ability of an elastomeric material. In such seal construction, the elastomeric materials used to form the static and dynamic seal surfaces, while being somewhat tailored to provide improved service at each such surface, must still remain chemically compatible with one another to permit the two to be chemically bonded together. Accordingly, while this type of seal construction provides a dynamic seal surface having improved wear resistance, when compared to a single-elastomer seal, the dynamic seal surface will still be the point of failure of the seal.

It is, therefore, desired that a journal seal be constructed in a manner that displays sealing properties that are equal to or better than those of seals formed exclusively from elastomeric materials. It is also desired that the seal construction display improved tribiological properties, improved wear resistance, a reduced coefficient of friction, and improved high-temperature endurance and stability when compared to conventional journal seals formed exclusively from elastomeric materials that are chemically cross-linked bonded together.

SUMMARY OF THE INVENTION

There is, therefore, provided in practice of this invention, multi-piece rotary cone drill bit seals, that include a dynamic sealing surface that is mechanically attached to a seal body independent of chemically bonding. Multi-piece seals of this invention comprise an annular seal body that is formed from a suitable energizing material, such as elastomers and rubbers. The seal body includes a static seal surface along one surface and a static energizing contacting surface along another of its surfaces. A remaining seal portion in the form of a seal jacket or seal cap is energized by the seal body along the contacting surface to provide a dynamic sealing surface thereto.

The seal jacket or cap is formed from a material that is different from the seal body and, more specifically, from a material that displays improved wear resistance when compared to the seal body. Suitable materials include those selected from the group including elastomeric materials, nonelastomeric materials, metallic materials, nonmetallic materials, and combinations thereof. A preferred seal jacket or cap material is a composite construction comprising a nonelastomeric polymer fabric that is impregnated with an elastomeric material. The seal jacket or cap is configured to be assembled with the seal body by mechanical attachment means. The term "mechanical" as used herein it intended to refer to all forms of attachment mechanisms that are achieved independent of chemical cross-linked bonding. Examples of such mechanical attachment means include, but are not limited to, attachments formed between two adjacent components by slip fit, interference fit, tongue and groove arrangements, adhesives, or alternative complementary geometric component configurations that enable the components to be cooperatively joined together without chemical cross-linked bonding. Multi-piece seals of this invention can be formed from two components, e.g., the seal body and the seal jacket or seal cap, or can be formed from three or more components, e.g, the seal body, seal jacket or cap, and one or more stiffening support members interposed therebetween.

Multi-piece seals of this invention, having a separate seal portion that forms the dynamic sealing surface and that is formed from wear resistance material, display enhanced wear resistance, reduced coefficient of friction, and improved high-temperature stability and endurance when compared to conventional rock bit seals formed only from single type of material or to those known O-ring seals previously described, thereby both extending the useful life of both the seals formed therefrom and of the rotary cone drill bits that employ such seals.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
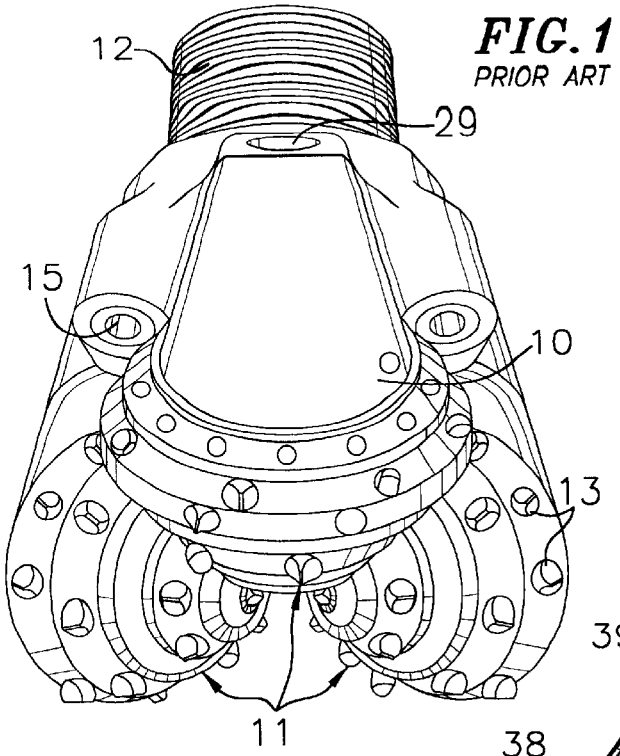
FIG. 1 PRIOR ART
FIG. 1 is a semi-schematic perspective of a rock bit.

FIG. 1 illustrates a rotary cone drill bit in the form of a rock bit that employs a multi-piece seal constructed according to principles of this invention. The rock bit comprises a body 10 having three cutter cones 11 mounted on its lower end, and a threaded pin 12 at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling fluid into the space around the cutter cones for cooling and carrying away formation chips drilled by the bit.

Multi-piece seals constructed according to principles of this invention can be embodied: (1) in the shape of an O-ring, comprising a circular inside and outside diameter, and having a circular cross section; (2) having a radial high-aspect ratio cross sectional geometry (i.e., the cross sectional radial width is greater than the axial width); or (3) having any other type of symmetrical or asymmetrical cross-sectional geometry. A key feature of multi-piece seals of this invention is that they have a multi-piece construction formed from different materials that are not chemically bonded together, which materials are chosen to provide improved performance characteristics at the particular seal location.

Figure 2:
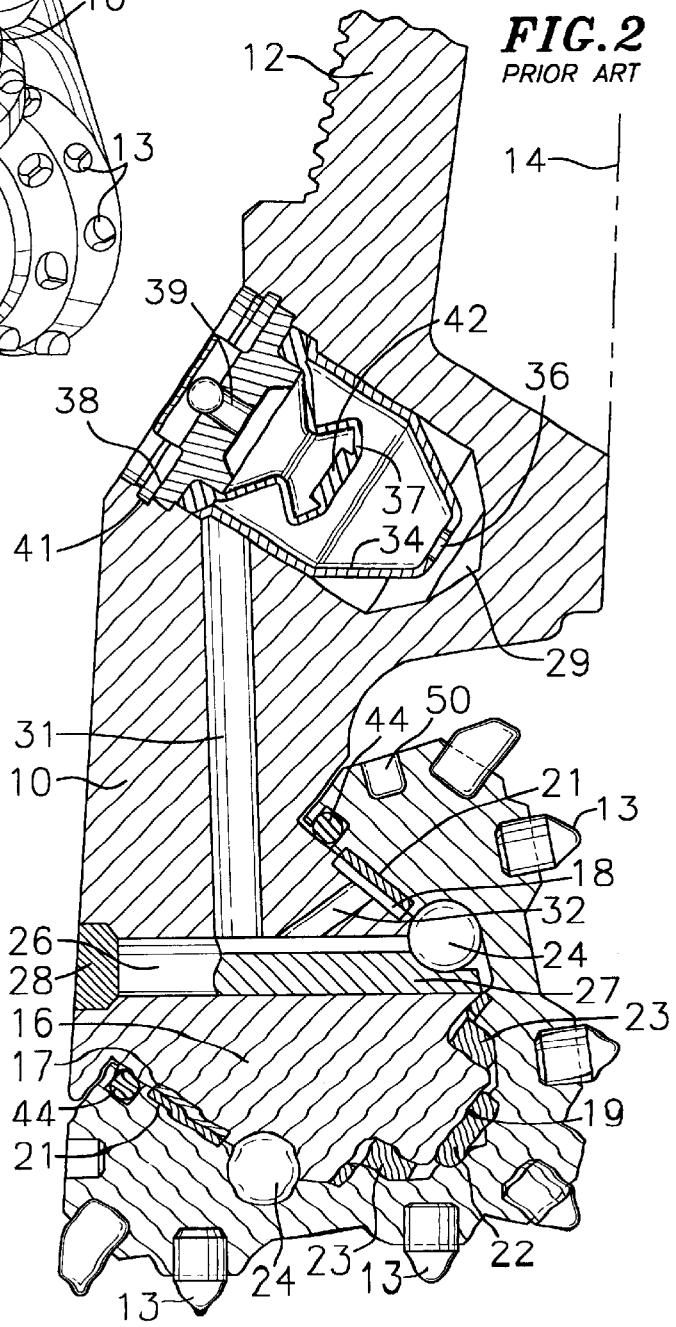
FIG. 2 PRIOR ART
FIG. 2 is a partial cross-sectional view of the rock bit comprising a conventional O-ring journal seal.

FIG. 2 is a fragmentary, longitudinal cross-section of the rock bit, extending radially from the rotational axis 14 of the rock bit through one of the three legs on which the cutter cones 11 (shown in FIG. 1) are mounted. Each leg includes a journal pin extending downwardly and radially, inwardly on the rock bit body. The journal pin includes a cylindrical bearing surface having a hard metal inlay 17 on a lower portion of the journal pin. The hard metal inlay is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60 percent or so of the circumference of the journal pin, and the hard metal inlay 17 can extend around the remaining 40 percent or so. The journal pin also has a cylindrical nose 19 at its lower end.

Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze inlay 21 deposited in a groove in the steel of the cone or as a floating inlay in a groove in the cone. The aluminum bronze inlay 21 in the cone engages the hard metal inlay 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the journal bearings illustrated herein. It is to be understood that multi-piece seals of this invention can be used with all types of rotary cone drill bits, e.g., rock and mining bits, comprising either roller bearings or conventional journal bearings or any other suitable bearing configuration.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place. The bearing surfaces between the journal pin and the cone are lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of a journal seal 50 between the cone and journal pin. In an alternative embodiment, the journal seal is in a slightly ramped or V-shaped groove.

A pressure compensation subassembly is included in the cavity 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41. Although a rotary cone drill bit having a pressure compensation subassembly is shown, it is to be understood that rotary cone drill bits are configured without such subassemblies. For example, rotary cone drill bits used in mining operations, i.e., mining bits, are used in operating conditions different from that of rock bits where pressure compensation is not necessary. Accordingly, it is to be understood that the particular bit illustrated in FIGS. 1 and 2 is provided for purposes of reference, and that multi-piece seals of this invention are intended to be used will all types of rotary cone drill bits.

When the rock bit is filled with grease, the bearings, the groove 18 on the journal pin, passages in the journal pin, the lubrication passage 31, and the grease reservoir on the outside of the bellows 37 are filled with grease, If the volume of grease expands due to heating, for example, the bellows 37 expands to provide additional volume in the sealed grease system, thereby preventing accumulation of excessive pressures. High pressure in the grease system can damage the journal seal 50 and permit drilling fluid or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the O-ring seal.

The bellows has a boss 42 at its inner end which can seat against the cap 38 at one end of the displacement of the bellows. The end of the bellows can also seat against the cup 34 at the other end of its stroke. If desired, a pressure relief check valve can also be provided in the grease reservoir for relieving over-pressures in the grease system that could damage the O-ring seal. Even with a pressure compensator, it is believed that occasional differential pressures may exist across the journal seal of up to 150 psi (550 kilopascals).

To maintain the desired properties of the journal seal at the pressure and temperature conditions that prevail in a rock bit, to inhibit "pumping" of the grease past the seal, and for a long useful life, it is important that the journal seal be resistant to crude oil and other chemical compositions found within oil wells, have a high heat and abrasion resistance, have low rubbing friction, and not be readily deformed under the pressure and temperature conditions in a well which could allow leakage of the grease from within the bit or drilling mud into the bit.

Journal seals conventionally employed in rock bits are shaped in the form of an O-ring and are formed from elastomeric or rubber materials, such as acrylonitrile polymers or acrylonitrile/butadiene copolymers. Other components sometimes used in the polymers include activators or accelerators for the curing, such as stearic acid, and agents that improve the heat resistance of the polymer, such as zinc oxide and curing agents. Synthetic rubbers used to form such seals typically exhibit poor heat resistance and are known to become brittle when exposed to elevated operating temperatures after extended periods of time, i.e., display poor high-temperature endurance and stability. Such compounds are also known to have undesirably low tensile strength and high coefficients of friction, and are not well suited for use in forming journal seals because of the high operating temperatures and aggressive wear that is know to occur in rock bits. Additionally, journal seals formed exclusively from elastomeric or rubber materials have also been found to have poor tribiological properties, further contributing to accelerated seal degradation during use.

Journal seals, constructed according to principles of this invention, have a multi-piece construction comprising an elastomeric energizing seal body and a remaining seal portion that is formed from a different material that is selected to provided improved properties at a desired seal location, e.g., to provide improved properties of wear resistance along a dynamic sealing surface of the seal. The seal body and remaining seal portion are assembled together to form the multi-piece seal and do not require chemical cross-linked bonding. Flexibility of not having to chemically cross-link bond is important because it eliminates the need to select seal materials on the basis of chemical compatibility, thereby allowing the seal to be formed from a greater variety of materials specifically tailored to meet the many different bit operating conditions. It is understood, however, that multi-piece seals of this invention can be assembled together by adhesive, i.e., by means that does not create chemical cross-linked bonding between the seal body and remaining sealing portion. Seals having such multi-piece construction offer key advantages when compared to conventional single-material seals, due to the high degree of high-temperature endurance and stability, improved wear resistance, and a reduced coefficient of friction afforded by the seal portion disposed along the seal dynamic surface.

The seal body is preferably formed from an elastomer or rubber material that is capable of providing an energizing function to urge the dynamic seal surface against a dynamic rock bit surface. Suitable elastomer and rubber materials include those mentioned above and others such as those selected from the group of fluoroelastomers including those available under the trade name Advanta manufactured by DuPont, carboxylated elastomers such as carboxylated nitrites, highly saturated nitrile (HSN) elastomers, nitrile-butadiene rubber (HBR), highly saturated nitrile-butadiene rubber (HNBR) and the like. Suitable elastomeric materials have a modulus of elasticity at 100 percent elongation of from about 500 to 2,000 psi (3 to 12 megapascals), a minimum tensile strength of from about 1,000 to 7,000 psi (6 to 42 megapascals), elongation of from 100 to 500 percent, die C tear strength of at least 100 lb/in. (1.8 kilogram/millimeter), durometer hardness Shore A in the range of from about 60 to 95, and a compression set after 70 hours at 100° C. of less than about 18 percent, and preferably less than about 16 percent. A preferred elastomeric material is a proprietary HSN manufactured by Smith International, Inc., under the product name HSN-8A.

Materials useful for forming the seal member that is energized by the seal body include elastomeric materials, nonelastomeric materials, metallic materials, non-metallic materials, and combinations thereof. It is desired that the seal member energized by the seal body be somewhat flexible to both enable installation of the multi-piece seal into the bit, and to enable the seal member to easily conform around the energizing seal body and to the contacting surface on the leg or cone to provide a desired seal there-against.

In a preferred embodiment, the seal member energized by the seal body is formed from composite materials having both nonelastomeric and elastomeric components that are adapted to provide properties of improved wear resistance when compared to elastomeric materials alone, and to non-elastomeric materials that are adapted to provide properties of improved wear resistance. One example composite material comprises a nonelastomeric component in the form of fibers such as those selected from the group consisting of polyester fiber, cotton fiber, aromatic polyamines (Aramids) such as those available under the Kevlar family of compounds, polybenzimidazole (PBI) fiber, poly m-phenylene isophthalamide fiber such as those available under the Nomex family of compounds, and mixtures or blends thereof. The fibers can either be used in their independent state and combined with an elastomeric composite component, or may be combined into threads or woven into fabrics with an elastomeric composite component. A preferred composite formed from a nonelastomeric polymeric material and an elastomeric material includes those having a softening point higher than about 350° F., and having a tensile strength of greater than about 10 Kpsi.

Other composite materials suitable for use in forming composite seals include those that display properties of high-temperature stability and endurance, wear resistance, and have a coefficient of friction similar to that of the polymeric material specifically mentioned above. If desired, glass fiber can be used to strengthen the polymeric fiber, in such case constituting the core for the polymeric fiber. An exemplary nonelastomeric polymeric material used for making the composite construction is a polyester-cotton fabric having a density of approximately eight ounces per square yard. The polymeric material is provided in the form of a fabric sheet having a desired mesh size.

Composite materials used to form seal constructions of this invention preferably comprise in the range of from 10 to 90 percent by volume polymeric material. A seal formed from a composite material comprising less than about 10 percent by volume of the polymeric material will not produce a desired degree of high-temperature stability and endurance, and wear resistance. A seal formed from a composite material comprising greater than about 90 percent by volume of the polymeric material will be too rigid and lack a desired degree of elasticity to act as a good seal material. A composite material comprising less than about 30 percent by volume of the elastomeric material will form a seal having a reduced degree of elasticity and poor compressibility. A composite material comprising greater than about 90 percent by volume of the elastomeric material will form a seal having an insufficient amount of the polymeric material to provide a desired degree of high-temperature stability and endurance, and wear resistance. A particularly preferred seal is formed from a composite material comprising approximately 50 percent by volume polymeric material.

The seal construction can include one or more lubricant additives, disbursed uniformly through the elastomeric material, to further reduce wear and friction along the surface of the seal. Suitable lubricant additives include those selected from the group consisting of polytetrafluoroethylene (PTFE), hexagonal boron nitride (hBN), flake graphite, molybdenum disulfide ($MoS_2$) and other commonly known fluoropolymeric, dry or polymeric lubricants, and mixtures thereof. The lubricant additive is used to provide an added degree of low friction and wear resistance to the elastomeric component of the composite material that is placed in contact with a rotating surface. A preferred lubricant additive is hBN manufactured by Advanced ceramics identified as Grade HCP, having an average particle size in the range of from about five to ten micrometers. hBN is a preferred lubricant additive because it provides a superior degree of lubrication when placed in contact with steel without producing harmful, e.g., abrasive, side effects to the journal or cone.

Multi-piece seals constructed according to principles of this invention preferably comprise up to about 20 percent by volume lubricant additive. A seal construction comprising greater than 20 percent by volume of the lubricant additive is not desired because it could interfere with or adversely effect desired mechanical properties of the elastomer material.

A composite material useful for forming the seal member positioned adjacent the energizing seal body can be prepared by dissolving a desired quantity of the selected uncured (liquid) elastomeric material in a suitable solvent. Solvents useful for dissolving the elastomeric material include those organic solvents that are conventionally used to dissolve rubber or elastomeric materials. A desired quantity of lubricant additive can be added to the elastomer mixture. The desired nonelastomeric polymeric material is then added to the dissolved elastomeric material so that it is completely immersed in and saturated by the elastomeric material. In an exemplary embodiment, the polymeric material is in the form of a fabric sheet that is placed into contact with the elastomeric material so that the sheet is completely impregnated with the elastomeric material. Preferably, the polymeric fabric sheet is impregnated with the elastomeric material by a calendaring process where the fabric sheet is fed between two oppositely positioned rotating metal rolls that are brought together to squeeze the fabric. The rolls are configured to contain a bank of the elastomeric mixture, which is forced into the fabric weave under pressure. The metal rolls are also heated to soften the elastomeric material and, thereby improve its penetration into the fabric.

The total number of polymeric fabric sheets that are used, and that are impregnated or saturated with the elastomeric material, depends on the desired build thickness of the seal member. If one long fabric sheet is impregnated, the sheet is cut and stacked one on top of another to build a desired seal thickness. Alternatively a number of shorter sheets can be impregnated, which are then stacked on top of one another. The exact number of sheets that are stacked to form a desired seal thickness depends on such factors as the type and thickness of the particular polymeric fabric that is used, as well as the particular seal construction. In another embodiment, however, the seal can be constructed having only a portion formed from the composite material, in which case the desired thickness of the composite material for the seal would be approximately the radial thickness of the designated composite portion.

The polymeric sheets are stacked and wound to provide the approximate radial thickness of the desired seal member, e.g., the dynamic seal surface. The axial ends of the stacked sheets are cut to the approximate axial thickness of the seal member and the cut ends are sewn to form a closed loop. The sewn sheets, now roughly in the form of the desired seal member and are placed into a mold. The mold is heated and pressurized to simultaneously form the seal and cure or vulcanize the elastomer component of the composite material. During the cure process, the elastomeric mixture in the polymeric fabric undergoes cross-linking reactions with itself to entrap the polymeric fabric within the elastomeric medium.

Figure 3:
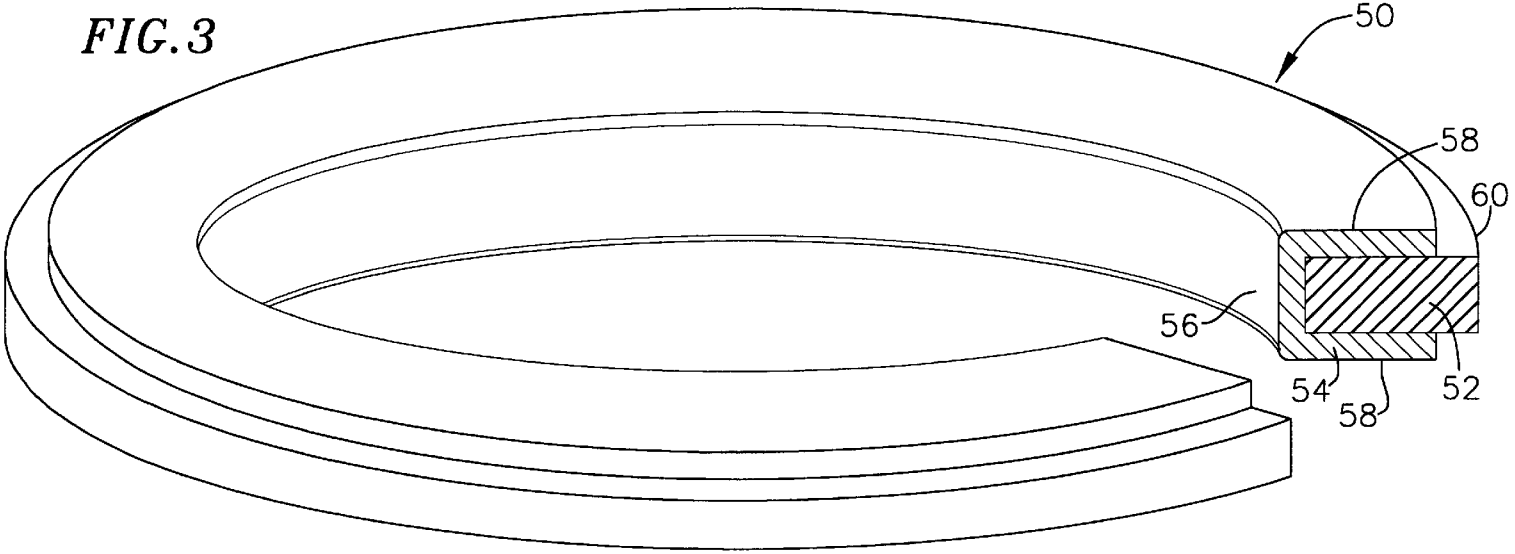
FIG. 3 is a cross-sectional view of an example multi-piece seal constructed according to the principles of this invention having a multi-piece construction.
Figure 4:
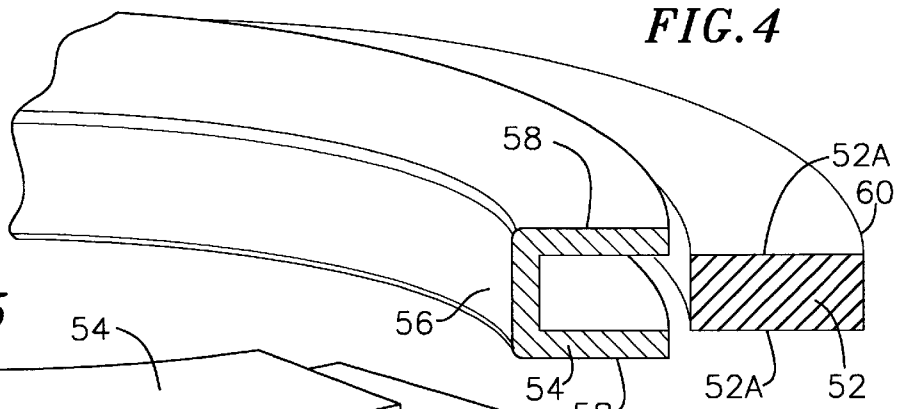
FIG. 4 is a cross-sectional exploded view of a the multi-piece seal of FIG. 3.
Figure 5:
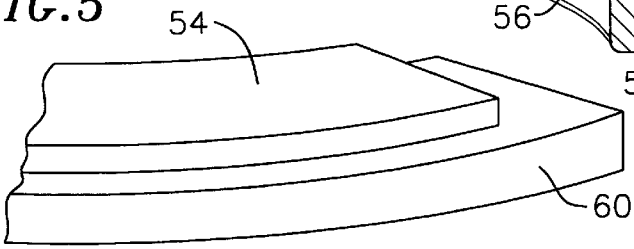
FIG. 5 is a front end view of the multi-piece seal of FIG. 3.

Referring to FIGS. 3 to 5, an example multi-piece seal of this invention 50 having a two-piece construction comprising a seal body 52 formed from a suitable energizing material such as an elastomer or rubber as discussed above, and a remaining seal member 54 that is formed from a different material that provides improved wear resistance when compared to the seal body, such as that disclosed above. As mentioned above, a wider variety of elastomeric materials can be used to form the remaining seal member, when compared to conventional two-elastomer seals, because of the avoidance of chemical cross-linked bonding. The seal portion 54 is in the form of a jacket that has a dynamic sealing surface 56 at one end, e.g., along an inside diameter, and that has sides 58 that extend around the seal body 52. The seal illustrated in FIGS. 3 to 5 is constructed having a dynamic sealing surface positioned along an inside diameter of the annular seal. However, it is to be understood the dynamic sealing surface could be positioned along other locations of the seal, in which case the seal jacket would be constructed and attached to provide a dynamic sealing surface at such position.

The jacket sides 58 are shaped and sized to fit around adjacent non-energizing sides 52*a* of the seal body 52 to enable the seal portion 54 to fit therearound. The seal jacket 54 is not chemically bonded to the seal body, but is held in position thereagainst by a slip or interference fit. It is desired that the seal jacket sides 58 extend axially a sufficient distance along the underlying seal body to ensure that the seal portion 54 remain coupled to the seal body non-energizing sides 52*a*. The amount by which the jacket sides 58 extend along the seal body is understood to vary depending on the particular seal application. For example, multi-piece seal can be configured so that the jacket sides extend completely around the sides of the seal body.

Although the seal portion 54 is illustrated in the form of a U-shaped member, it is to be understood that the seal portion can be shaped differently as long as it both provides a dynamic seal surface and enables attachment to the seal body. Additionally, while the seal body has been illustrated has having a high aspect ratio, e.g., an aspect ratio greater than 1 where the seal body radial length is greater than the seal body axial width, the seal body 52 can be configured differently, and can have a static seal surface 60 shaped other than as illustrated, e.g, can have other symmetric or asymmetric cross-sectional geometries. Additionally, if desired, the seal body can be formed from one or more elastomer or rubber material that is bonded together to provide the desired energizing properties.

Figure 6:
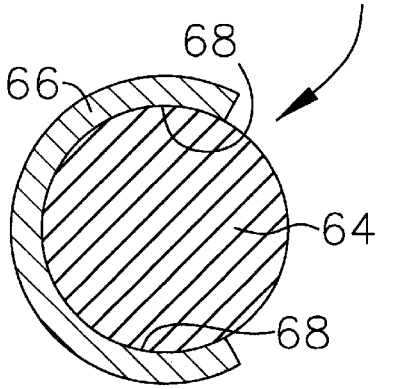
FIG. 6 is a cross-sectional view of another example multi-piece seal constructed according to the principles of this invention.

For example, FIG. 6 illustrates a multi-piece seal 62 of this invention having an energizing seal body 64 in the form of an O-ring, and having a remaining seal portion 66 in the form of a semi-circular jacket disposed over a portion of the seal body circumference. The seal body and jacket are each formed from those materials discuss above and are attached together without chemical cross-linked bonding by placement of circular jacket side walls 68 over underlying wall surfaces of the seal body.

Figure 7:
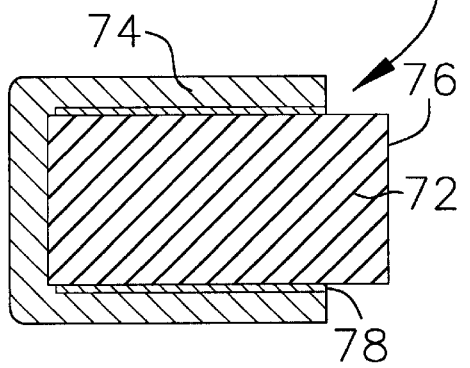
FIGS. 7 to 9 are cross-sectional views of other example multi-piece seals of this invention comprising an optional stiffening member interposed between seal pieces.
Figure 8:
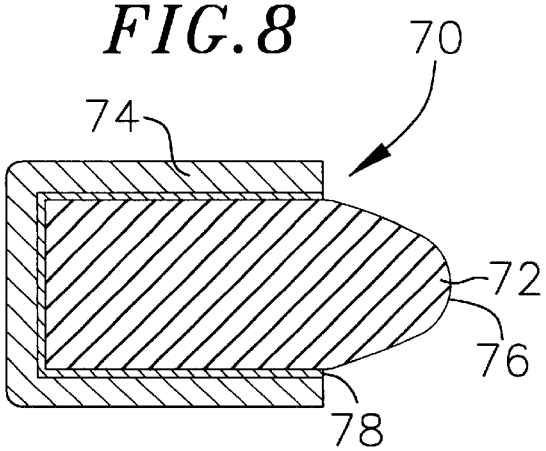
Figure 9:
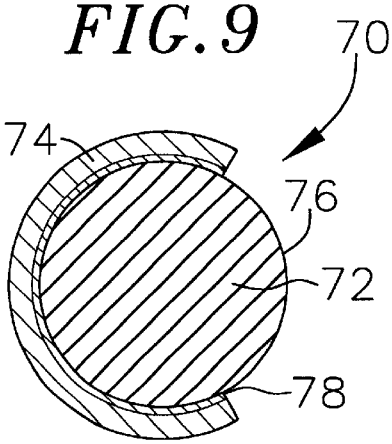

FIGS. 7 to 9 illustrate another embodiment of seals 70 made according to the principles of this invention each comprising a seal body 72 formed from a suitable energizing material, and having a remaining seal portion 74 in the form of a jacket that is attached over an adjacent portion of the seal body 72 without chemical cross-linked bonding. Each of FIGS. 7 to 9 illustrate seals having different geometries for uses in particular applications. It is to be understood that seals of this invention may have a static sealing surface 76 that is shaped differently, e.g., that have a substantially planar surface (FIG. 7) that have a non-planar surface (FIGS. 8 and 9), to provide a desired interaction with an adjacent rock bit static surface.

The seals illustrated FIGS. 7 to 9 each include one or more optional stiffening support members 78 interposed between the seal body 72 and seal jacket 74 to prevent the seal jacket from separating from the seal body when the seal is operating in harsh applications, thereby providing a multi-piece seal construction. The stiffening member 78 is integrally attached to the seal jacket by mechanical or chemical means so that the seal jacket and stiffening member form a combined assembly. The stiffening member 78 can extend completely around the seal body and seal jacket (as shown in FIGS. 8 and 9), or can be positioned only partially along seal jacket surfaces, e.g., along the side wall portions of the seal jacket (as shown in FIG. 7). The stiffening member 78 can be made from conventional materials capable of providing structural support such as thin metals, metal alloys, rigid polymers or plastics, in the form of a continuous-wall structure, or in the form of a screen or similar support. The stiffening member 78 may be mechanically linked or chemically cross-linked bonded to the seal jacket 74 surface.

Figure 10:
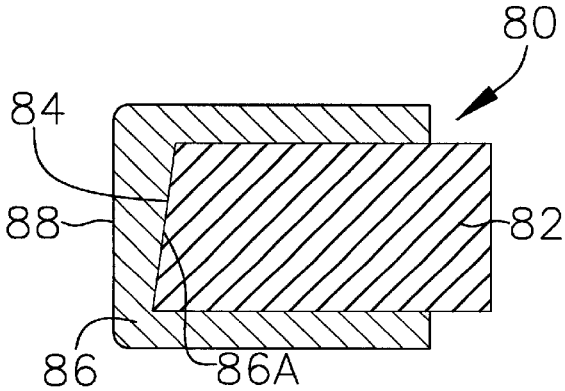
FIGS. 10 and 11 are cross-sectional views of other example multi-piece seals of this invention comprising a modified interface between seal members.
Figure 11:
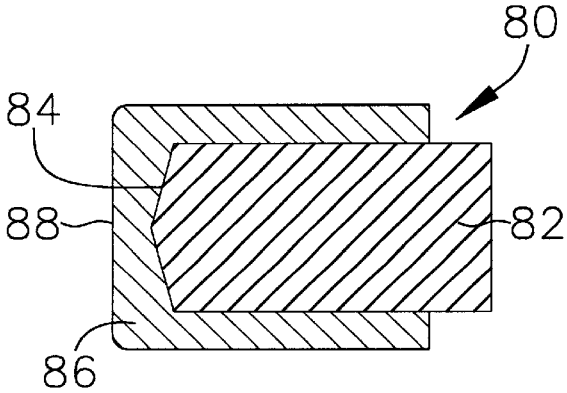

FIGS. 10 and 11 each illustrate multi-piece seals 80 of this invention comprising a seal body 82 having a static wall surface 84 in contact with a static wall surface 86*a* of the seal jacket 86 that has a modified cross-sectional profile, e.g., that does not have a constant inside diameter when moving axially therealong. It is desired to construct the seal body contacting wall surface 84 in such manner to control amount of contact force, e.g., control the contact pressure profile, that is imposed along the axial width the seal jacket 86, thereby controlling the contact force profile imposed along the axial width of the dynamic sealing surface 88. The ability to control and tailor the pressure profile across the dynamic seal surface is desired, for example, in applications where the dynamic sealing surface is exposed to different pressures on both axial sides or different fluids, e.g., mud, abrasives, and grease. It should be understood that the contacting wall surface 84 can be planar or non-planar shape, as long as it is different than the dynamic sealing surface 88 and functions to vary the contact pressure along the dynamic sealing surface 88.

FIG. 10 illustrates a seal body 82 having a contacting wall surface 84 that is tapered outwardly, moving axially downwardly therealong, to impose a greater contact force along a bottom portion of the seal jacket 86 and dynamic sealing surface 88, thereby making the contact pressure higher on the drilling mud side of the seal to prevent the ingress of abrasive particles contained in the drilling mud. FIG. 11 illustrates a seal body 82 having a V-shaped contacting static wall surface 84 positioned against a generally complementary static wall surface within the seal jacket. This embodiment provides additional contact area between the seal body and seal jacket, thereby helping to prevent rotation between the jacket 86 and seal body 82.

FIGS. 3 to 11 illustrate seal embodiments of this invention that incorporate a jacket component, e.g, remaining seal portion that is shaped having static wall portions that are sized and configured to fit over a generally complementary seal body surface. Having the remaining seal portion in jacket shape is preferred in harsh drilling applications, e.g., applications where there is a high hydrostatic drilling environment or drilling with drilling mud with a high solids content. The jacket embodiments provide robust means to prevent separation of the sealing member from the energizing member of the seal in a harsh drilling application. When drilling applications are not as harsh, such as air drilling and shallow drilling with drilling mud, a seal embodiment comprising a remaining seal portion in the form of a cap can be used.

Figure 12:
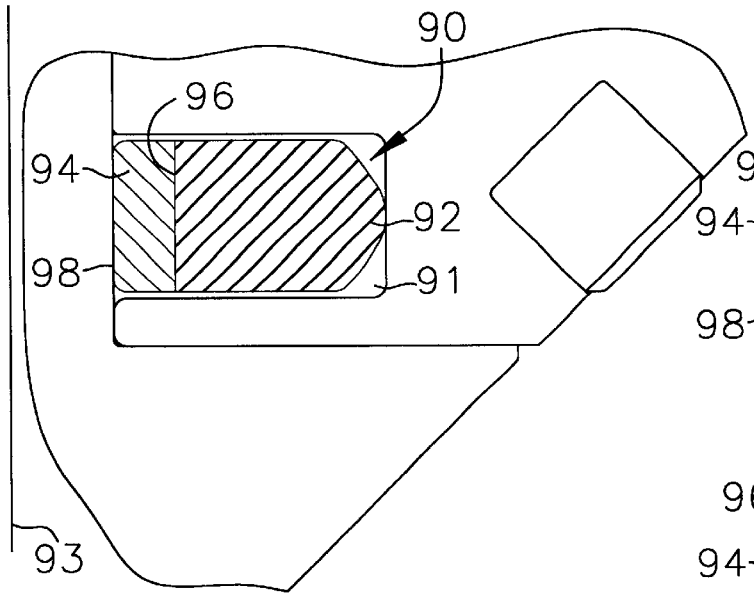
FIGS. 12 to 19 are cross-sectional views of other example multi-piece seals of this invention comprising a multi-piece construction.
Figure 13:
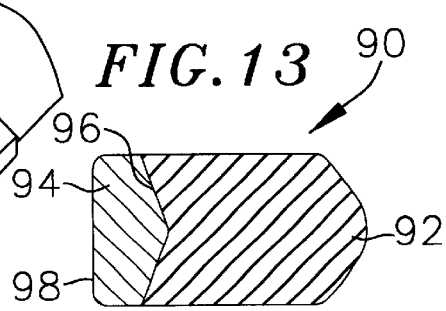
Figure 14:
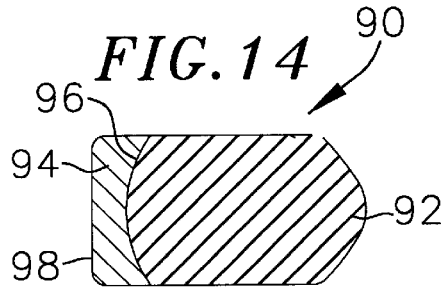

FIGS. 12 to 14 illustrate example multi-piece seal embodiments 90 of this invention comprising an annular energizing seal body 92 formed from the above-described energizing materials, with a remaining seal portion 94 in the form of a cap that is placed over an adjacent seal body static contacting surface 96, thereby providing a two-piece seal. The cap can be formed from the same materials as described above for the seal jacket. The cap 94 is not chemically cross-linked bonded to the seal body, but is rather maintained in position by slip or interference fit in the confining seal gland 91 shown in FIG. 12. For example, for embodiments where the dynamic sealing surface 98 is positioned along an inside seal diameter, the cap 96 in constructed having a static contacting surface that generally complements and fits snugly against the seal body static contacting surface 96.

Additionally, as illustrated in FIGS. 13 and 14, the seal body static contacting surface 96 and adjacent cap surface can be configured having a geometry, e.g., a modified contoured interface with one another, that promotes contact and attachment between adjacent seal members. FIG. 13, for example illustrates a seal body having a V-shaped cross-sectional profile, and FIG. 14 illustrates a seal body having a convex cross-sectional profile, for purposes of enhancing non-chemically bonded attachment between adjacent complementary cap interfacing surfaces.

Figure 15:
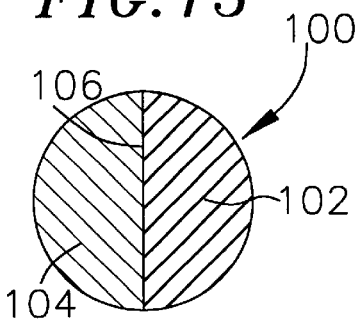

FIG. 15 illustrates another multi-piece seal embodiment 100 that is similar to that illustrated in FIGS. 13 and 14 and described above, comprising an annular energizing seal body 102 and a remaining seal portion 104 in the form of an annular cap, except that the seal 100 has a circular cross-sectional profile and the seal body contacting surface 106 is planar. Although the seal cap 104 is illustrated positioned along the seal body inside diameter to provide a dynamic sealing surface therealong, it is to be understood that the seal cap 104 can be positioned differently to provide a dynamic seal surface along different portions of the seal.

Figure 16:
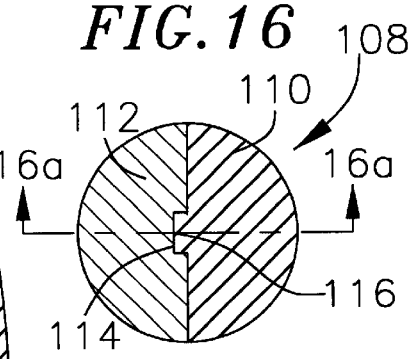
Figure 16A:
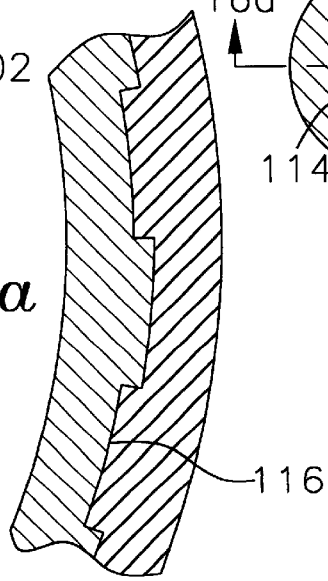

FIG. 16 illustrates a multi-piece seal embodiment 108 similar to that illustrated in FIG. 15 and described above, comprising an annular semi-circular seal body 110 and an semi-circular seal cap 112 disposed therearound, except that the seal body contacting surface 114 is configured to provide an enhanced attachment against a complementary seal cap surface. As illustrated in FIG. 16, the seal body contacting surface 114 is in the form of an outwardly depending projection that is shaped to fit within a complementary groove 116 of the seal cap 112 to provide an enhanced attachment therebetween for preventing relative axially seal body-to-seal cap movement during rock bit operation. The projection can extend complement along the seal body contacting surface, or along only a portion thereof as shown in FIG. 16*a*, that illustrates interlocking projections and grooves in both the seal body and seal cap. Similar interlocking projections 114 and complementary groove 116 can be used on contacting surfaces 96 of FIGS. 12 to 14 to enhance attachment for preventing relative axial movement.

Figure 17:
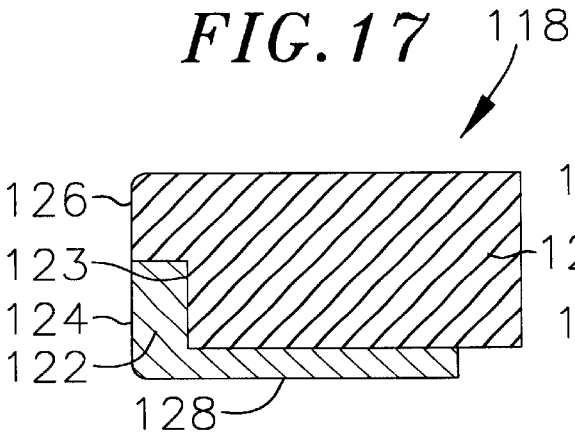

FIG. 17 illustrates another multi-piece seal embodiment 118 comprising an annular energizing seal body 120 with a remaining seal portion 122 or partial cap attached without chemical cross-linked bonding along an contacting surface 123 of the seal body to provide a partial dynamic seal surface 124. In this seal embodiment, the remaining seal portion 122 is configured to provide only a partial dynamic surface 124, while the remaining dynamic seal surface 126 is provided by the energizing seal body. Accordingly, in this embodiment the seal body both energizes to provide a desired contact force to the remaining seal portion 122 and respective dynamic sealing surface 124, and provide a dynamic sealing surface 126 itself. It should be understood that the partial cap 122 can be of any configuration as long as it provides a portion of the sealing function. Additionally, the seal embodiment of FIG. 17 illustrates a partial cap having a side wall surface 128 that extends over an axial surface of the seal body to provide an improved nonbonded attachment thereto and/or to provide a dynamic sealing surface therealong.

Figure 18:
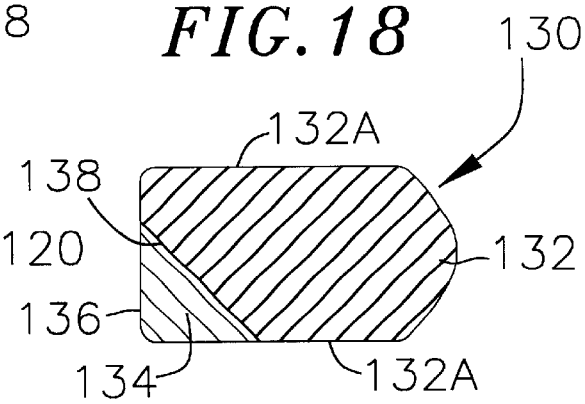
Figure 19:
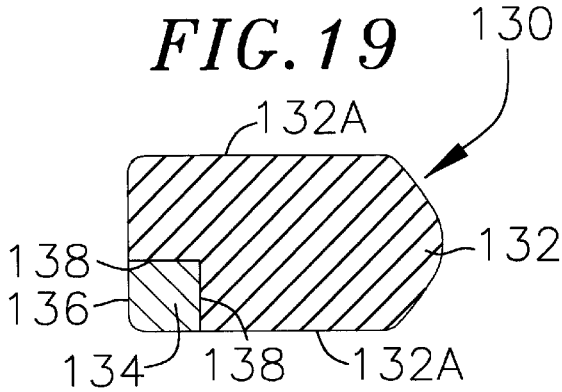

FIGS. 18 and 19 each illustrate multi-piece seal embodiments 130 comprising an energizing seal body 132 having a remaining seal portion 134 in the form of a seal cap attached without chemical cross-linked bonding to the seal body to provide a partial dynamic sealing surface 136. Again, like described above and illustrated in FIG. 17, the seal comprises a dynamic sealing surface formed partially by both the energizing seal body 132 and the seal cap 134. The seal embodiments illustrated in FIGS. 18 and 19 differ, however, in that neither one uses seal cap having a wall surface disposed over the body side surface 132*a*. Both seals illustrated in FIGS. 18 and 19 have differently configured seal body contacting surfaces 138 to ensure nonbonded attachment to complementary seal cap surfaces.

Figure 20:
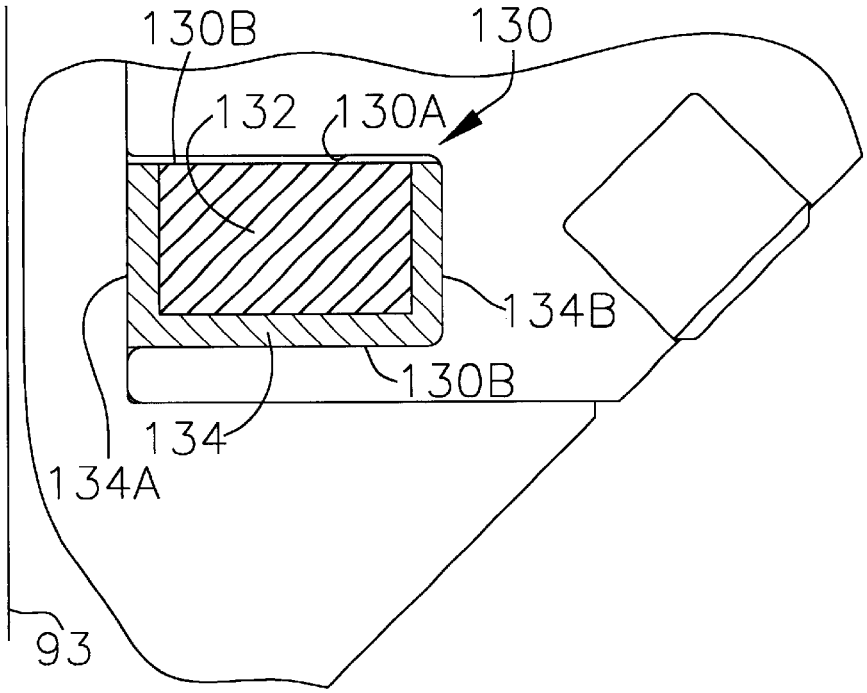
FIG. 20 is a cross-sectional side view of another multi-piece seal embodiment of this invention disposed within a rock bit cone groove.

FIG. 20 illustrates a multi-piece seal embodiment 130 comprising the energizing body 132 and the seal jacket 134 that is positioned over both the dynamic portion 134*a* and static portion 134*b* of the seal. Such seal embodiment is desired for use in harsh application where the static portions sometimes becomes dynamic. The seal embodiment 130 is shown disposed within a groove in the rock bit cone and is radially energized therein. The groove can also be in the rock bit leg. The term "groove" as used above is intended to refer to a cutout portion in a rock bit component. When a seal is disposed in a groove, the seal is at least partially confined in non-energized directions by primarily non-energizing surfaces 130*b* of the rock bit component comprising such groove. The term "radially energized" refers to an installed state of the seal where all or at least a majority of the deflecting forces on the seal are in the radial direction relative to the axis of the journal bearing. For example, FIGS. 12 and 20 each illustrates a multi-piece seal of this invention that is radially energized relative to the axis 93 of the journal bearing.

FIGS. 2, 12 and 20 each illustrate embodiments of multi-piece seals of this invention as installed within a groove disposed in the rock bit cone. Alternatively, it is to be understood that multi-piece seals of this invention can be configured such that they are disposed within a groove disposed in the rock bit leg rather than the cone. Further, multi-piece seals of this invention can be configured such that they are disposed within grooves formed in each of the adjacent cone and rock bit leg surfaces.

Figure 21:
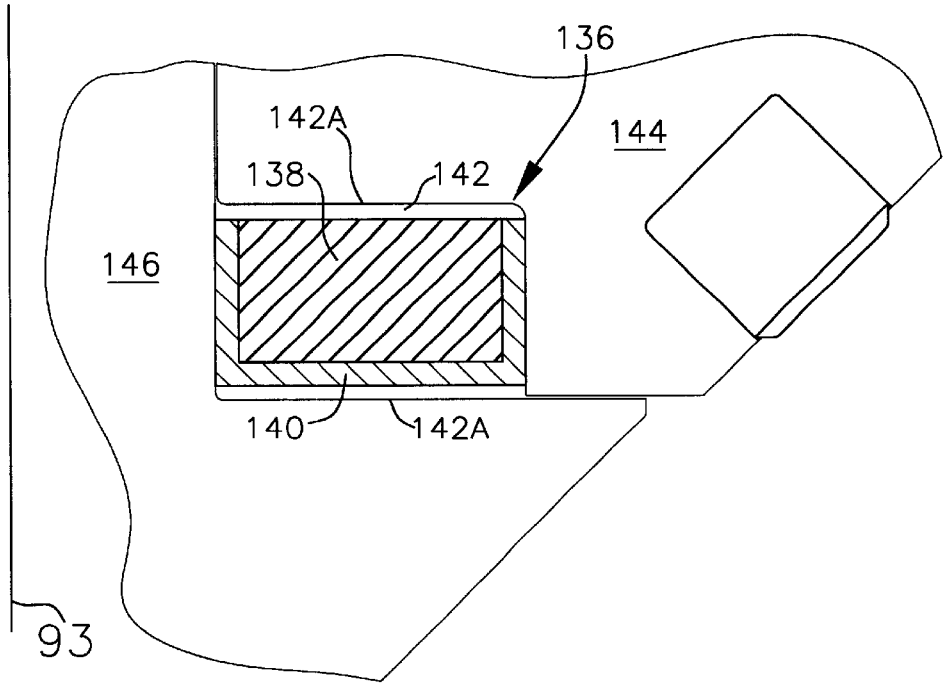
FIG. 21 is a cross-sectional side view of another multi-piece seal embodiment of this invention disposed within a rock bit interstice.

FIG. 21 illustrates a multi-piece seal embodiment 136 similar to that illustrated in FIG. 20 and described above comprising the energizing body 138 and the seal jacket 140 that completely encases the exposed surfaces of the seal body and is positioned over both the dynamic and static portions of the seal. Unlike the seal illustrated in FIG. 20 however, the seal embodiment 136 is disposed within an interstice 142 that is formed between the rock bit cone 144 and leg 146. The term "interstice" as used herein refers to an annular space that is formed between rock bit components in which, unlike a groove, no portion of each pair of opposed non-energizing rock bit surfaces 142*a* are of a single rock bit component. The multi-piece seal 136 is radially energized relative to the journal bearing axis 93.

Figure 22:
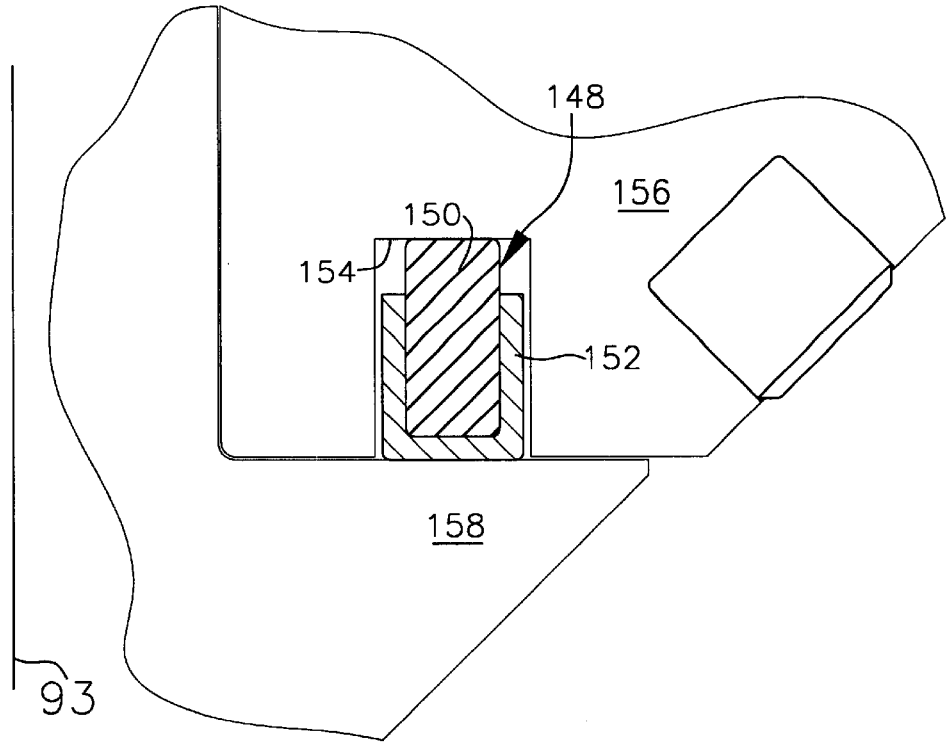
FIG. 22 is a cross-sectional side view of another multi-piece seal embodiment of this invention disposed within a rock bit cone groove, and as placed in axially energized service.

FIG. 22 illustrates another multi-piece seal embodiment 148 comprising the energizing body 150 and the seal jacket 152 that is positioned over the dynamic portion of the seal. However, in this particular seal embodiment the dynamic seal surface is positioned at one axial seal end, and the static seal surface is positioned an opposite axial seal end. The seal 148 is disposed within a groove 154 that is recessed axially within the rock bit cone 156, and is axially energized therein between the cone 156 and rock bit leg 158. The term "axially energized" means that all or at least a majority of the seal deflecting forces are directed in an axial direction relative the axis 93 of the journal bearing. It should be understood that embodiments depicted may be partially energized axially and radially or energized in another manner. For example, embodiments of the multi-piece seal of this invention can be installed in a groove that is angled between 0 and 90 degrees relative to the axis of the journal.

Figure 23:
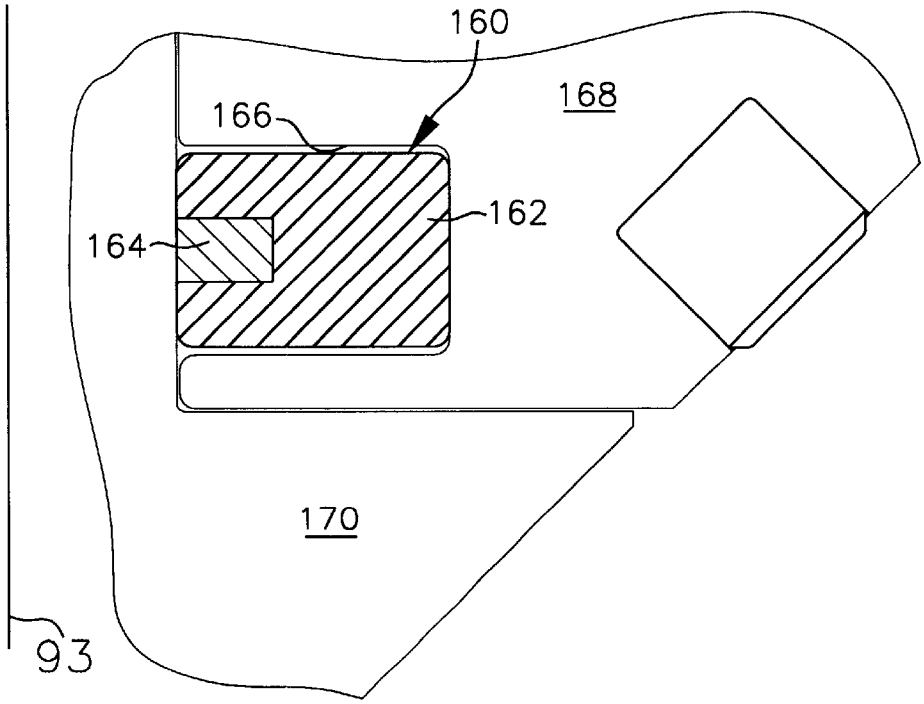
FIG. 23 is a cross-sectional side view of another multi-piece seal embodiment of this invention disposed within a rock bit cone groove, and as placed in radially energized service.

FIG. 23 illustrates another multi-piece seal embodiment 160 comprising the energizing body 162 having a remaining seal portion 164 in the form of a seal cap attached without chemical cross-linked bonding to the seal body to provide a partial dynamic sealing surface. In this particular embodiment, the seal portion 164 is configured to fit within a groove disposed within the seal body surface. Alternatively, it is to be understood that the seal can be configured so that the remaining seal portion 164 is disposed within a radial surface of the seal body 160 to provide a seal embodiment comprising a dynamic sealing surface along a radial seal surface that is at least partially formed by the remaining seal portion 164. The seal 160 is radially energized, relative to the axis 93 of the journal bearing, against a leg 170 surface, and is disposed within a groove 160 formed in the rotary cone 168.

Figure 24:
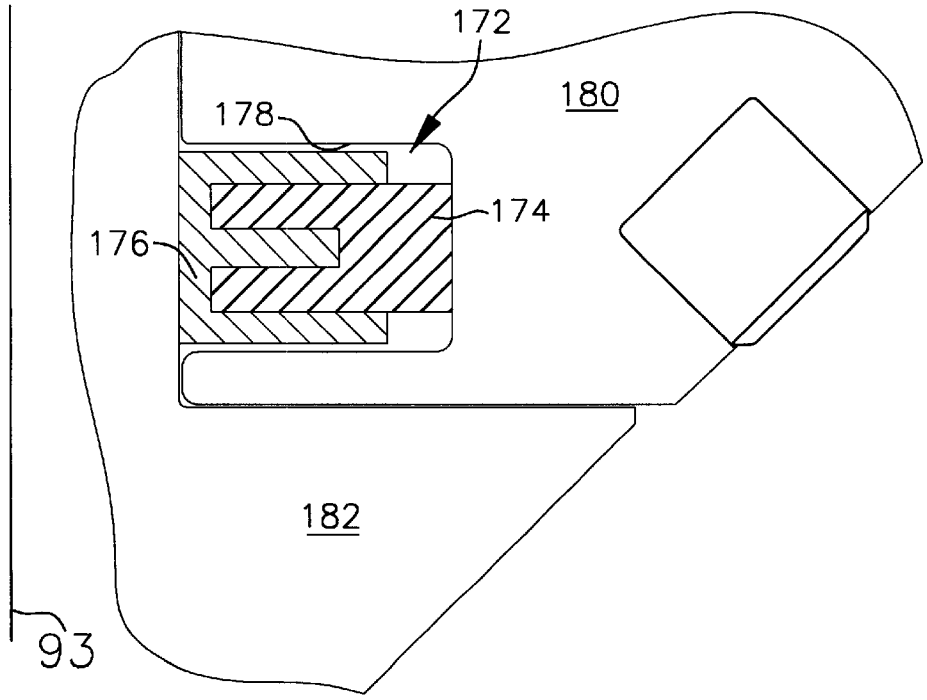
FIG. 24 is a cross-sectional side view of another multi-piece seal embodiment of this invention disposed within a rock bit cone groove, and as placed in radially energized service.

FIG. 24 illustrates a still other multi-piece seal embodiment 172 comprising the energizing body 174 having a seal jacket 176 that is disposed without chemical cross-linked bonding around an axial seal body surface, and that covers at least a portion of opposite seal body radial surfaces. In this particular embodiment, the seal jacket includes a tongue that is disposed within a groove within the seal body to help form a mechanical attachment therewith. The seal 172 is radially energized, relative to the axis 93 of the journal bearing, against a leg 182 surface, and is disposed within a groove 178 formed in the rotary cone 180.

Although the multi-piece seal embodiments described and illustrated above have a dynamic sealing surface formed along an inside diameter surface, it is understood that the dynamic sealing surface can be located along other positions of the seal. Additionally, it to be understood that although seal embodiments of this invention are described and illustrated configured in the form of an O-ring, other symmetrical and asymmetrical cross-sectional seal geometries are understood to be within the scope of this invention. Further, although multi-piece seal embodiments of this invention are described and illustrated as not having seal bodies and remaining seal portions that are chemically bonded together, means other than those described and illustrated for providing a mechanical attachment therebetween is intended to be within the scope of this invention, such as pining and stapling. It should also be understood that the embodiments of multi-piece seals of this invention can be disposed within a groove or an interstice formed within or by either or both the bit cone and/or leg.

Although, limited embodiments of multi-piece seals for rock bits have been described and illustrated herein, many modifications and variations will be apparent to those skilled in the art. For example, although the multi-piece seal has been described and illustrated for use with rock bits, it is to be understood that multi-piece seals constructed according to principles of this invention can also be used with other types of rotary cone bits, such as drill bits, mining bits or the like. Accordingly, it is to be understood that within the scope of the appended claims, that multi-piece seals according to principles of this invention may be embodied other than as specifically described herein.

What is claimed is:

1. A method for assembling a multi-piece ring seal for use in a rotary cone rock bit that comprises a bit body including at least one leg and having a bearing surface disposed thereon, and a cutter cone rotatably mounted on the leg and including a bearing surface, wherein the method comprises the steps of:

mechanically combining a first seal portion formed from energizing material with a second seal portion to form a ring seal assembly, wherein the second seal portion is positioned over at least one energizing surface and at least one nonenergizing surface of the first seal portion, wherein the second seal portion includes a seal dynamic sealing surface; and installing the ring seal assembly between the rock bit leg and cone so that the seal dynamic sealing surface is placed in rotary contact with a leg or cone surface.

2. A rotary cone drill bit for drilling subterranean formations comprising;

a bit body including at least one leg and having a bearing surface disposed thereon;

a cutter cone rotatably mounted on the leg and including a bearing surface that is lubricated with grease;

a multi-piece ring seal interposed between the leg and cone for retaining the grease along the bearing surfaces, the ring seal comprising:

an energizing seal body formed from an elastomeric material; and a flexible sealing member in contact with and not chemically cross-linked bonded to the energizing body to form a seal dynamic sealing surface;

wherein the energizing body further comprises first and second non-energizing opposite sides, and wherein the flexible sealing member extends around at least a portion of at least one of the first and second opposite sides.

3. The bit as recited in claim 2 wherein the flexible sealing member is generally "U" shaped.

4. The bit as recited in claim 2 wherein the flexible sealing member is generally "L" shaped.

5. The bit as recited in claim 2 wherein the flexible sealing member is generally "C" shaped.

6. The bit as recited in claim 2 wherein the dynamic sealing surface is nonplanar.

7. The bit as recited in claim 2 wherein the dynamic sealing surface is planar.

8. The bit as recited in claim 2 wherein the flexible member comprises a stiffening member attached thereto.

9. The bit as recited in claim 8 wherein the stiffening member is positioned adjacent to at least one of the first or second non-energizing sides of the energizing body.

10. The bit as recited in claim 8 wherein the stiffening member substantially surrounds the energizing body.

11. The bit as recited in claim 8 wherein the stiffening member is at least partially formed from a metallic material.

12. The bit as recited in claim 11 wherein the stiffening member is formed from a non-metallic material.

13. The bit as recited in claim 2 wherein the flexible member is mechanically attached to the seal body.

14. The bit as recited in claim 13 wherein the flexible member and seal body include at least one cooperating projection and groove to facilitate mechanical attachment therebetween.

15. The bit as recited in claim 2 wherein the ring seal is installed within a groove formed between the leg and cone.

16. The bit as recited in claim 15 wherein the groove is formed in the leg.

17. The bit as recited in claim 15 wherein the groove is formed in the cone.

18. The bit as recited in claim 2 wherein the flexible member is primarily axially energized.

19. The bit as recited in claim 2 wherein the flexible member is primarily radially energized.

20. The bit as recited in claim 2 wherein the flexible member is both axially and radially energized.

21. The bit as recited in claim 2 wherein the flexible member is formed from an elastomeric material having a property of wear resistance that is different than that of the elastomeric material used to form the seal body.

22. The bit as recited in claim 2 wherein the flexible material at least partially comprises a non-elastomeric material component.

23. The bit as recited in claim 22 wherein the non-elastomeric material component is a fiber.

24. The bit as recited in claim 23 wherein the fiber is woven into one or more fabric sheets.

25. The bit as recited in claim 23 wherein the fiber is dispersed in an elastomeric material.

26. The bit as recited in claim 2 wherein the ring seal is installed within an interstice between the leg and cone.

27. The bit as recited in claim 2 wherein the seal dynamic sealing surface is positioned within the rock bit in rotary contact with the cone.

28. The bit as recited in claim 2 wherein the seal dynamic sealing surface is positioned within the rock bit in rotary contact with the leg.

29. The bit as recited in claim 2 wherein the seal body is in the form of an O-ring.

30. The bit as recited in claim 2 wherein the seal body has an aspect ratio greater than one.

31. The bit as recited in claim 2 wherein the energizing seal body forms a substantially static seal against an adjacent surface of the drill bit.

32. A rotary cone rock bit for drilling subterranean formations comprising;

a bit body including at least one leg projecting therefrom that has a bearing surface disposed thereon;

a cutter cone rotatably mounted on the leg and including bearing surface that is lubricated with grease; and a multi-piece ring seal interposed between the leg and cone for retaining the grease along the bearing surfaces, the ring seal comprising:

an energizing seal body formed from an elastomeric material and including two opposed energizing surfaces and two opposed nonenergizing surfaces; and a flexible sealing member connected but not bonded to one of the energizing seal body energizing surfaces and at least one of the energizing seal body nonenergizing surfaces, the flexible sealing member including a seal dynamic sealing surface placed into rotary contact against an adjacent drill bit surface.

33. The rock bit as recited in claim 32 wherein the energizing seal body and flexible sealing member are mechanically attached together.

34. The rock bit as recited in claim 33 wherein the energizing seal body and flexible sealing member include at least one cooperating projection and groove to facilitate mechanical attachment therebetween.

35. The rock bit as recited in claim 32 wherein the ring seal is disposed within a groove between the rock bit leg and cone.

36. The rock bit as recited in claim 35 wherein the groove is in the leg.

37. The rock bit as recited in claim 35 wherein the groove is in the cone.

38. The rock bit as recited in claim 32 wherein the seal ring is disposed within an interstice between the rock bit leg and cone.

39. A rotary cone rock bit for drilling subterranean formations comprising;

a bit body including at least one leg projecting therefrom and having a bearing surface disposed thereon;

a cutter cone rotatably mounted on the leg and including a bearing surface lubricated with a grease; and a multi-piece ring seal interposed between the leg and cone for retaining the grease along the bearing surfaces, the ring seal comprising:

a first seal portion that defines a seal body and that provides an energizing function, the first seal portion including opposed energizing surfaces and opposed nonenergizing surfaces; and a second seal portion that is flexible and that is mechanically attached with the first seal portion along one energizing surface and at least one nonenergizing surface, the second seal portion comprising a seal dynamic sealing surface that is placed into rotary contact against a rock bit surface, the first and second seal portions being formed from different materials.

40. The rock bit as recited in claim 39 wherein the second seal portion is formed from a material having better wear resistance than the material used to form the first seal portion.

41. The rock bit as recited in claim 39 wherein the second seal portion is a composite material comprising an elastomeric and a non-elastomeric component.

42. The rock bit as recited in claim 41 wherein the non-elastomeric component is fiber.

43. The rock bit as recited in claim 42 wherein the fiber is woven into one or more fabric sheets, and the composite material comprises a number of such sheets impregnated with the elastomeric component.

44. A rotary cone rock bit for drilling subterranean formations comprising;

a bit body including at least one leg extending therefrom and having a bearing surface disposed thereon;

a cutter cone rotatably mounted on the leg and including a bearing surface lubricated with a grease;

a multi-piece ring seal interposed between the leg and cone for retaining the grease along the bearing surfaces, the ring seal comprising:

an elastomeric seal body that comprises opposed energizing surfaces and opposed nonenergizing surfaces; and a flexible seal member engaged to the elastomeric seal body about at least one energizing surface and at least one nonenergizing surface, one of the seal body and the seal member forming a substantially static seal with one of the rock bit leg and cone surfaces, the seal member forming a rotary dynamic seal with the other of the rock bit leg and cone surfaces, wherein the seal body and seal member are not bonded together.

45. The rock bit as recited in claim 44 wherein the seal body and seal member are mechanically attached together.

46. The rock bit as recited in claim 44 wherein the seal member engages two of the energizing or nonenergizing surfaces.

47. A rotary cone rock bit for drilling subterranean formations comprising;

a bit body including at least one leg extending therefrom and having a bearing surface disposed thereon;

a cutter cone rotatably mounted on the leg and including a bearing surface that is lubricated with a grease; and a multi-piece ring seal interposed between the leg and cone for retaining the grease along the bearing surfaces, the ring seal comprising:

a first elastomeric seal portion the defines a seal body and that provides an energizing function, the seal body comprising opposed energizing and nonenergizing surfaces; and a second flexible seal portion disposed along at least one energizing surface and one nonenergizing surface of the seal body, the second seal portion having a seal dynamic sealing surface for rotatably contacting a rock bit surface, and an opposed static surface for contacting the first seal portion, wherein the dynamic seal surface and the static surface have different surface geometries.

48. The rock bit as recited in claim 47 wherein the first seal portion includes a surface that forms a substantially static seal against an adjacent surface of the drill bit.

49. The rock bit as recited in claim 47 wherein the first seal portion has a static surface that contacts the second seal portion static surface, and wherein the static surfaces of each first and second seal portion are nonplanar.

* * * * *